US007809580B2

(12) United States Patent
Hotho et al.

(10) Patent No.: US 7,809,580 B2
(45) Date of Patent: Oct. 5, 2010

(54) ENCODING AND DECODING OF MULTI-CHANNEL AUDIO SIGNALS

(75) Inventors: Gerard Herman Hotho, Eindhoven (NL); Francois Philippus Myburg, Eindhoven (NL); Dirk Breebaart, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 769 days.

(21) Appl. No.: 11/718,241

(22) PCT Filed: Oct. 31, 2005

(86) PCT No.: PCT/IB2005/053550

§ 371 (c)(1),
(2), (4) Date: Apr. 30, 2007

(87) PCT Pub. No.: WO2006/048817

PCT Pub. Date: May 11, 2006

(65) Prior Publication Data

US 2009/0055194 A1 Feb. 26, 2009

(30) Foreign Application Priority Data

Nov. 4, 2004 (EP) ..... 04105527
Apr. 18, 2005 (EP) ..... 05103079
Apr. 27, 2005 (EP) ..... 05103443

(51) Int. Cl.
*G10L 19/00* (2006.01)

(52) U.S. Cl. ..... 704/501; 704/230

(58) Field of Classification Search ..... 704/222, 704/230, 500–504

See application file for complete search history.

(56) References Cited

U.S. PATENT DOCUMENTS 7,394,903 B2 * 7/2008 Herre et al. ..... 381/23
7,447,629 B2 * 11/2008 Breebaart ..... 704/219
7,646,875 B2 1/2010 Schuijers et al.
2004/0086130 A1 * 5/2004 Eid et al. ..... 381/20

(Continued)

OTHER PUBLICATIONS

Herre, J. et al.: "MP3 Surround: Efficient and compatible Coding of Multi-Channel Audio"; Audio Engineering Society, Convention Preprint, May 8, 2004, pp. 1-14, XP002338414.

(Continued)

*Primary Examiner*—Abul Azad

(57) ABSTRACT

An encoding device (1) for converting a first number (M) of input audio channels into a second, smaller number (N) of output audio channels comprises at least one conversion unit (12) for converting a first signal (Lf; Rf; Co) and a second signal (Lr; Rr; Le) into a third signal (L; R; C) and a fourth signal (Ls; Rs; Cs). The third, dominant signal contains most of the signal energy of the first and second signals, while the fourth, residual signal contains the remainder of said signal energy. The encoding device is arranged for using the third signal (L; R; C) to produce an output signal and for outputting the fourth signal (Ls; Rs; Cs). A decoding device (2) for converting a first number (N) of input audio channels into a second, larger number (M) or output audio channels comprises at least one conversion unit (24) for converting a first signal (L; R; C) and a second signal (Ld; Rd; Ld) into a third signal (Lf, Rf; Co) and a fourth signal (Lr; Rr; Le). The first, dominant signal contains most of the signal energy of the third and fourth signal, while the second, residual signal contains the remainder of said signal energy. The encoding device is arranged for receiving at least one-second signal (Ld; Rd; Cd).

20 Claims, 9 Drawing Sheets

1

U.S. PATENT DOCUMENTS

Figure 1:
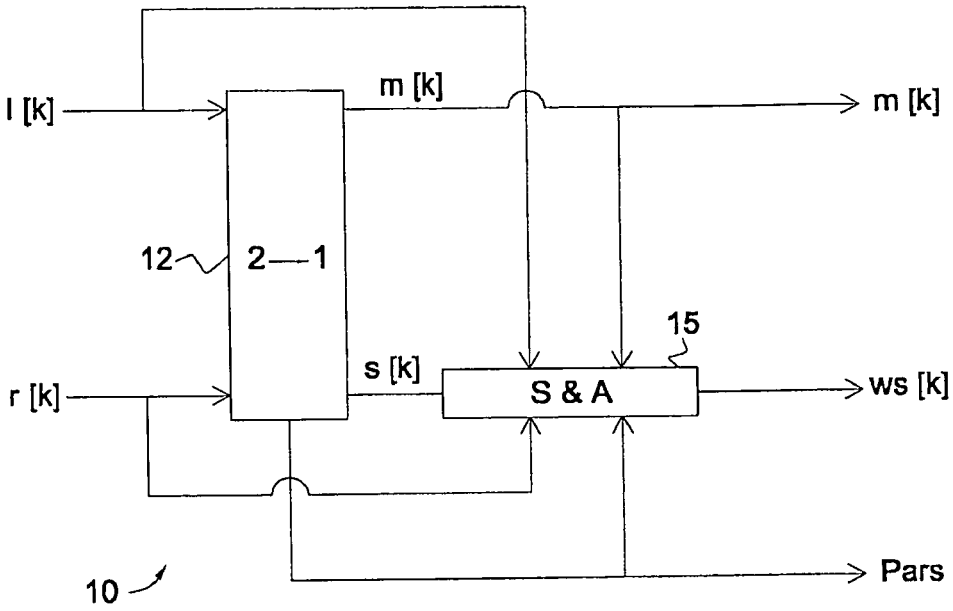

| | | | | |
|---|---|---|---|---|
| 2006/0009225 | A1 * | 1/2006 | Herre et al. | 455/450 |
| 2008/0195397 | A1 * | 8/2008 | Myburg et al. | 704/500 |

OTHER PUBLICATIONS

Grill, Bernhard: "MP3 in MPEG-4"; preprints of papers presented at the AES Convention, Oct. 10, 2003, pp. 1-7, XP008042559.

Van Der Waal, R.G. et al.: "Subband coding of stereophonic digital audio signals"; Speech Processing 2, VLSI, Underwater Signal Processing, Toronto, May 14-17, 1991; International Convention on Acoustics, Speech & Signal Processing, ICCASSP, New York, IEEE, US vol. 2 Conf. 16, Apr. 14, 1991, pp. 3601-3604, XP010043648.

* cited by examiner

1

2'

ENCODING AND DECODING OF MULTI-CHANNEL AUDIO SIGNALS

The present invention relates to multi-channel encoding and decoding. More in particular, the present invention relates to a device and a method for converting a number of audio channels into a smaller number of audio channels (encoding), and a device and a method for converting a number of audio channels into a larger number of audio channels (decoding).

Audio systems using multiple channels are well known. While conventional stereo systems use only two audio channels, modern 5.1 systems use 6 channels: left front (lf), left rear (lr), right front (rf), right rear (rr), center (co) and low frequency effect (lfe or le). The larger number of channels has caused an increase in the amount of audio data to be stored and/or transmitted. This data increase has given rise to efforts to reduce the amount of data by coding.

One of these coding techniques is known as Mid/Side (M/S) coding or Sum/Difference coding, discussed in the paper by J. D. Johnston and A. J. Ferreira: "Sum-difference stereo transform coding", *Proceedings of the International Conference on Acoustics and Speech Signal Processing* (*ICASSP*), San Francisco, USA, 1992, pp. II 569-572. Mid/Side coding is typically used for encoding a pair of stereo signals. Using M/S coding an audio signal consisting of a first (e.g. left) signal l[n] and a second (e.g. right) signal r[n] is coded as a sum signal m[n] and a difference (or residual) signal s[n]:

$$m[n]=r[n]+l[n]$$

$$s[n]=r[n]-l[n] \tag{1}$$

For (almost) identical signals l[n] and r[n] this gives a large coding gain as the corresponding difference signal s[n] is close to zero, whereas the sum signal contains practically all signal energy. Hence, in this situation the bit rate required for coding the sum and difference signals is close to the bit rate required for coding only a single channel.

Alternatively the Mid/Side coding process of formula (1) can be described by means of a rotation matrix:

$$\begin{pmatrix} m[n] \\ s[n] \end{pmatrix} = c\begin{pmatrix} \cos(\frac{\pi}{4}) & \sin(\frac{\pi}{4}) \\ -\sin(\frac{\pi}{4}) & \cos(\frac{\pi}{4}) \end{pmatrix}\begin{pmatrix} l[n] \\ r[n] \end{pmatrix} \tag{2}$$

Here, the left and right signals have been rotated over an angle of $\pi/4$. The sum signal can be interpreted as a projection of the left and right samples onto the line l=r whereas the difference (or residual) signal can be interpreted as a projection of the left and right samples onto the line l=−r.

This technique can be generalized by allowing rotation angles other than $\pi/4$. In order to minimize the signal power in the residual signal (i.e., maximizing the coding gain) for a wide class of input signals, the rotation angle may further be signal dependent. The following unitary rotation may be applied to a pair of channels:

$$\begin{pmatrix} m'[n] \\ s'[n] \end{pmatrix} = c\begin{pmatrix} \cos(\alpha) & \sin(\alpha) \\ -\sin(\alpha) & \cos(\alpha) \end{pmatrix}\begin{pmatrix} l[n] \\ r[n] \end{pmatrix} \tag{3}$$

where m'[n] and s'[n] represent the dominant and the residual signal respectively and the angle $\alpha$ is chosen to minimize the power of the residual signal, thus maximizing the power of the dominant signal. This generalized rotation technique is often referred to as Principal Component Analysis (PCA).

As the rotation of formula (3) minimizes the power of the residual signal, the residual signal is typically considered to contain little perceptually relevant information, in particular at higher frequencies. For this reason, conventional encoding systems discard the residual signals produced in the rotation of formula (3) and in similar transformations.

Although the techniques referred to above are primarily aimed at stereo signals, they may be applied to audio signals having multiple channels, such as 5.1 signals, by repeatedly reducing a pair of signals to a dominant signal that is stored and/or transmitted and a residual signal that is discarded.

Discarding the residual signals of course results in a data reduction. However, the present inventors have realized that only a significant data reduction is achieved when the residual signal contains a relatively large amount of information. Discarding the residual signal in such cases inevitably results in an undesirable perceptual distortion of the audio signal.

In decoding devices, the techniques discussed above are used to reconstruct the original signals from the encoded signals. If M/S encoding has been used, for example, both a dominant signal and a residual signal are required to reproduce the original signal pair by an inverse rotation. In Prior Art decoding devices, the residual signals are not received and therefore a synthetic residual signal is derived from each dominant signal using a decorrelator. Although this allows the original signals to be approximated, the waveform of the synthetic residual signals typically differs from the waveform of the actual residual signals. As a result, there will be a discrepancy between the decoded signals and the original signals.

It is an object of the present invention to overcome these and other problems of the Prior Art and to provide an encoding device and a decoding device which allow an improved signal quality.

Accordingly, the present invention provides an encoding device for converting a first number of input audio channels into a second number of output audio channels, where the first number is larger than the second number, the device comprising at least two conversion units, each for converting a first signal and a second signal into a third signal and a fourth signal, the third signal containing most of the signal energy of the first and second signal, and the fourth signal containing the remainder of said signal energy, which encoding device is arranged for using the third signals to produce an output signal, wherein the encoding device is further arranged for outputting a fourth signal.

By outputting at least one fourth signal, that is, an above-mentioned residual signal instead of discarding it, a significantly better reconstruction of the original signal can be produced by the decoder.

If an encoding device comprises more than two conversion units, the fourth signal is preferably output for each conversion unit, although this is not essential and the fourth signal of selected conversion units could be used to enhance the signal quality at the decoder. It is noted that the conversion units could be arranged in parallel or in series (cascade), and that the conversion units may have more than two input channels, for example three.

Although it is possible to output an entire fourth signal, that is, for the entire duration of the first and second signals, it is preferred to select time segments for which the fourth signal is to be output. More in particular, by selecting perceptually relevant time segments (for example time frames), the transmission or storage capacity necessary for transmitting or storing the fourth signal(s) is reduced while still providing a significant signal quality improvement over the Prior Art. For example, only time segments containing frequencies lower than 5 kHz could be selected, thus using a frequency dependent selection.

In a further preferred embodiment, the selection of time segments or signal parts is accomplished by substantially passing perceptually relevant parts of the fourth (that is, residual) signals, attenuating perceptually less relevant parts of the fourth signal and suppressing least relevant parts of the fourth signals. That is, the signal parts (or frames) are divided into at least three groups: those signal parts being perceptually the most relevant are passed substantially without being attenuated, those signal parts being perceptually less relevant are also passed but are attenuated, and those signal parts being perceptually least relevant are suppressed. In this way, a smoother transition between signal parts each having a different relevance is achieved, resulting in a higher signal quality.

The perceptual relevance may be determined in a number of ways, for example by using a weighting function which provides a weighting (that is, gain or attenuation) value dependent on a ratio, for example the power ratio of the fourth signal and the third signal of a conversion unit during a particular time segment.

Instead of, or in addition to the selection of time and/or frequency segments of the respective channels, also the channels for which the fourth signal is output may be selected. If at least two conversion units are arranged in a cascade, preferably the conversion unit nearest to the output terminal of the encoding device is selected to output its fourth signal, while the fourth signal of one or more conversion units further away (in the signal processing direction) may be discarded. In other words, conversion units downstream (in the signal processing direction) are selected before other conversion units to output their respective fourth signal. The present inventors have realized that fourth signals produced nearest to the output terminal, that is in the last stages, of the encoding device will typically be used in the first stages of the decoding device and therefore have the greatest relevance for the quality of the decoded signal. For this reason, it is preferred that these fourth signals are transmitted while the fourth signals of conversion units having less relevance may be discarded, in particular when the available transmission capacity does not allow the transmission of all fourth signals.

This selection of conversion units may be temporary or permanent. If temporary, all conversion units may be provided with a selection unit which may pass or block the respective fourth signal in dependence on the available transmission capacity or other factors. If permanent, the selection units of certain conversion units, typically furthest from the output terminal of the device, may be omitted.

The present invention also provides a decoding device for decoding audio signals which have been encoded using an encoding device as defined above. Accordingly, the present invention provides a decoding device for converting a first number of input audio channels into a second number of output audio channels, where the first number is smaller than the second number, the device comprising at least two conversion units, each for converting a first signal and a second signal into a third signal and a fourth signal, the first signal containing most of the signal energy of the third and fourth signal, and the second signal containing the remainder of said signal energy, the device further comprising at least one decorrelation unit for decorrelating a first signal so as to produce a synthetic second signal, which decoding device is further arranged for receiving at least one additional second signal.

By receiving an additional second signal (that is, the residual signal referred to as fourth signal in the encoding device), an improved quality of the decoded audio signal may be achieved, as any synthetic residual signal generated in the decoding device is typically not identical to the original residual signal.

In a preferred embodiment, the received second signal is combined with the derived synthetic second signal, such that the second signal fed to the conversion unit is a combination of the two signals. This has the advantage that the synthetic residual signal is always available, also for the time segments for which no residual signal is transmitted. For those time segments for which a residual signal is indeed transmitted, the residual signal used by the conversion unit is a combination of the transmitted residual signal and the synthetic residual signal, and will therefore only partially consist of the synthetic residual signal.

In a preferred embodiment, the decoding device is provided with attenuation units controlled by the received residual signals for attenuating the synthetic residual signals. This allows smoother transitions between selected and unselected residual signals and avoids any switching artifacts. More in particular, this allows the amplitude of each synthetic residual signal to be controlled by the corresponding received residual signal. Accordingly, a much improved mix of the synthetic residual signal and the actual transmitted residual signal is achieved.

In the above, reference is made to M/S and PCA encoding. Alternatively, or additionally, amplitude-related encoding techniques can be used.

It is noted that the present invention relates to spatial audio coding, that is audio coding typically involving more than two channels, as opposed to stereo coding which involves only two channels.

The present invention further provides a method of converting a first number of input audio channels into a second number of output audio channels, where the first number is larger than the second number, the method comprising at least two steps of converting a first signal and a second signal into a third signal and a fourth signal, the third signal containing most of the signal energy of the first and second signals, and the fourth signal containing the remainder of said signal energy, and the step of using the third signals to produce an output signal, which method comprises the further step of outputting a fourth signal.

The present invention still further provides a method of converting a first number of input audio channels into a second number of output audio channels, where the first number is smaller than the second number, the method comprising at least two steps of converting a first signal and a second signal into a third signal and a fourth signal, the first signal containing most of the signal energy of the third and fourth signals, and the second signal containing the remainder of said signal energy, and the step of deriving the second signal from the first signal, which method comprises the further step of receiving an additional second signal.

The method may comprise the further step of decorrelating a first signal so as to produce the derived synthetic second signal. Preferably, the method comprises the still further step of attenuating the synthetic second signal, said step being controlled by a corresponding received second signal. Advantageously, the method may comprise the yet further steps of combining the synthetic second signal and the received second signal, and using the combined signal in the conversion step.

The present invention additionally provides a computer program product for carrying out the encoding and/or decoding methods defined above. A computer program product may comprise a set of computer executable instructions stored on a data carrier in the form of a computer readable storage medium, such as a CD or a DVD. The set of computer executable instructions, which allow a programmable computer to carry out the methods as defined above, may also be available for downloading from a remote server, for example via the Internet.

The present invention will further be explained below with reference to exemplary embodiments illustrated in the accompanying drawings, in which:

FIG. 1 schematically shows part of an encoding device according to the present invention.

Figure 2:
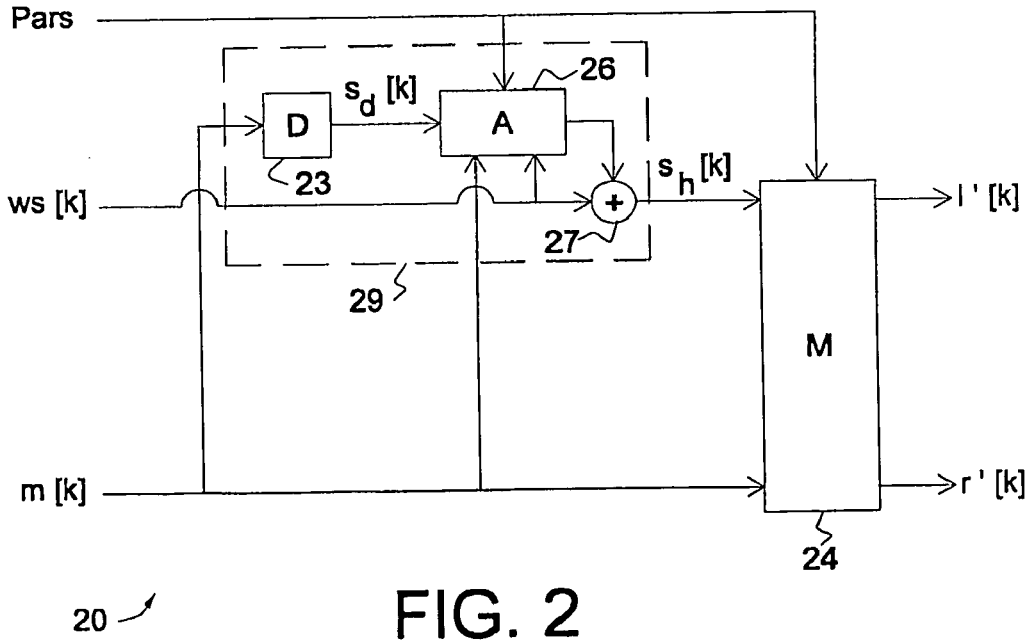

FIG. 2 schematically shows part of a decoding device according to the present invention.

Figure 3:
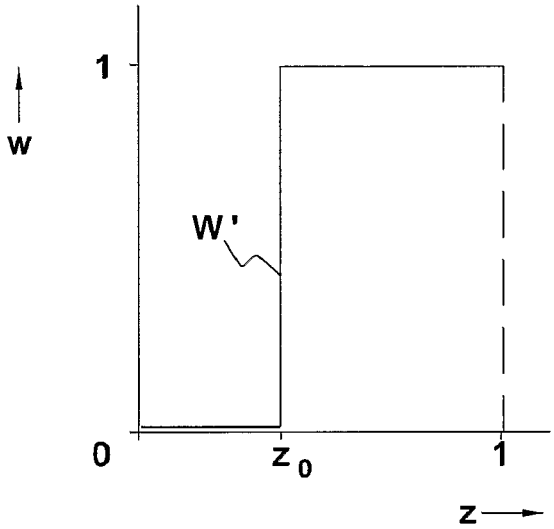
FIG. 3 PRIOR ART

FIG. 3 schematically shows a signal selection function according to the Prior Art.

Figure 4:
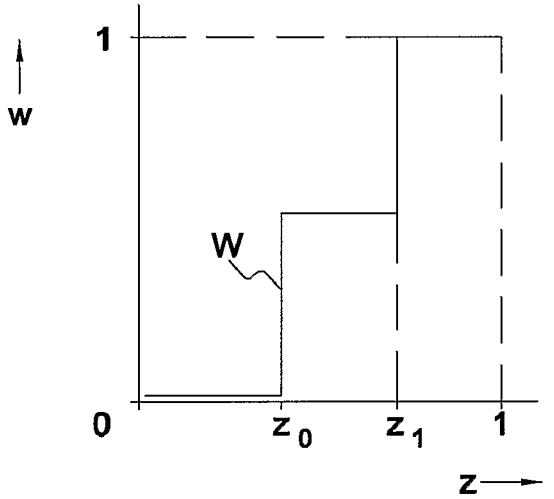

FIG. 4 schematically shows a first signal selection function according to the present invention.

Figure 5:
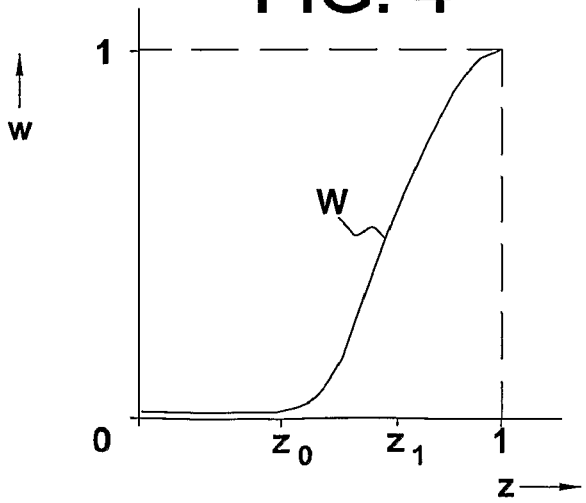

FIG. 5 schematically shows a second signal selection function according to the present invention.

Figure 6:
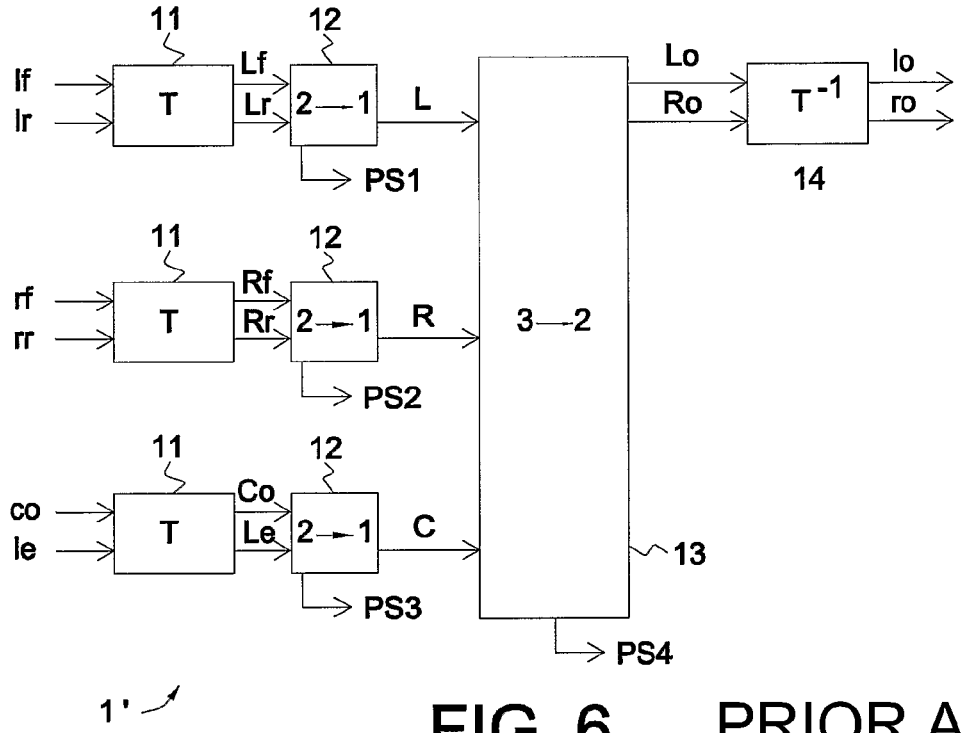
FIG. 6 PRIOR ART

FIG. 6 schematically shows a first embodiment of an encoding device according to the Prior Art.

Figure 7:
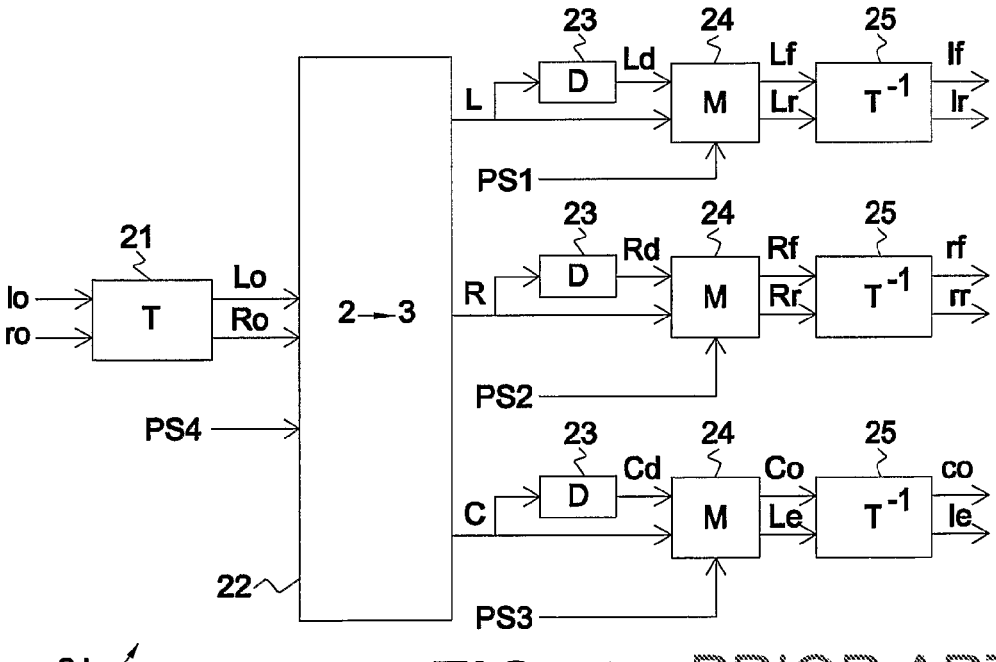
FIG. 7 PRIOR ART

FIG. 7 schematically shows a first embodiment of an exemplary decoding device according to the Prior Art.

Figure 8:
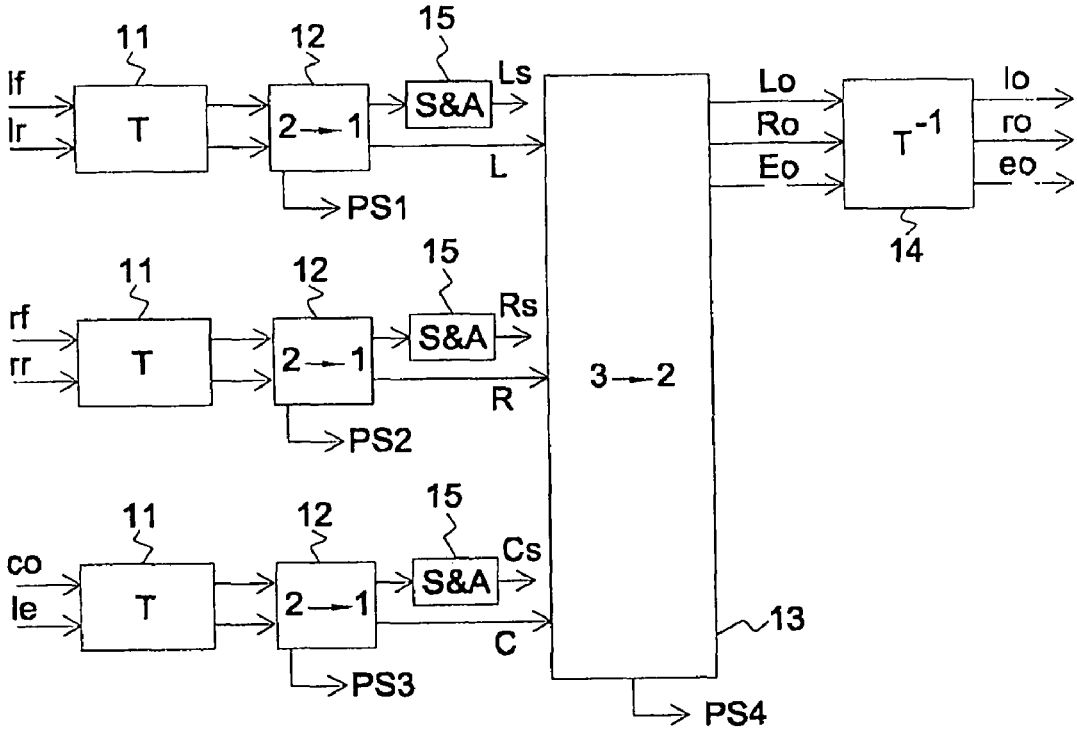

FIG. 8 schematically shows a first embodiment of an encoding device according to the present invention.

Figure 9:
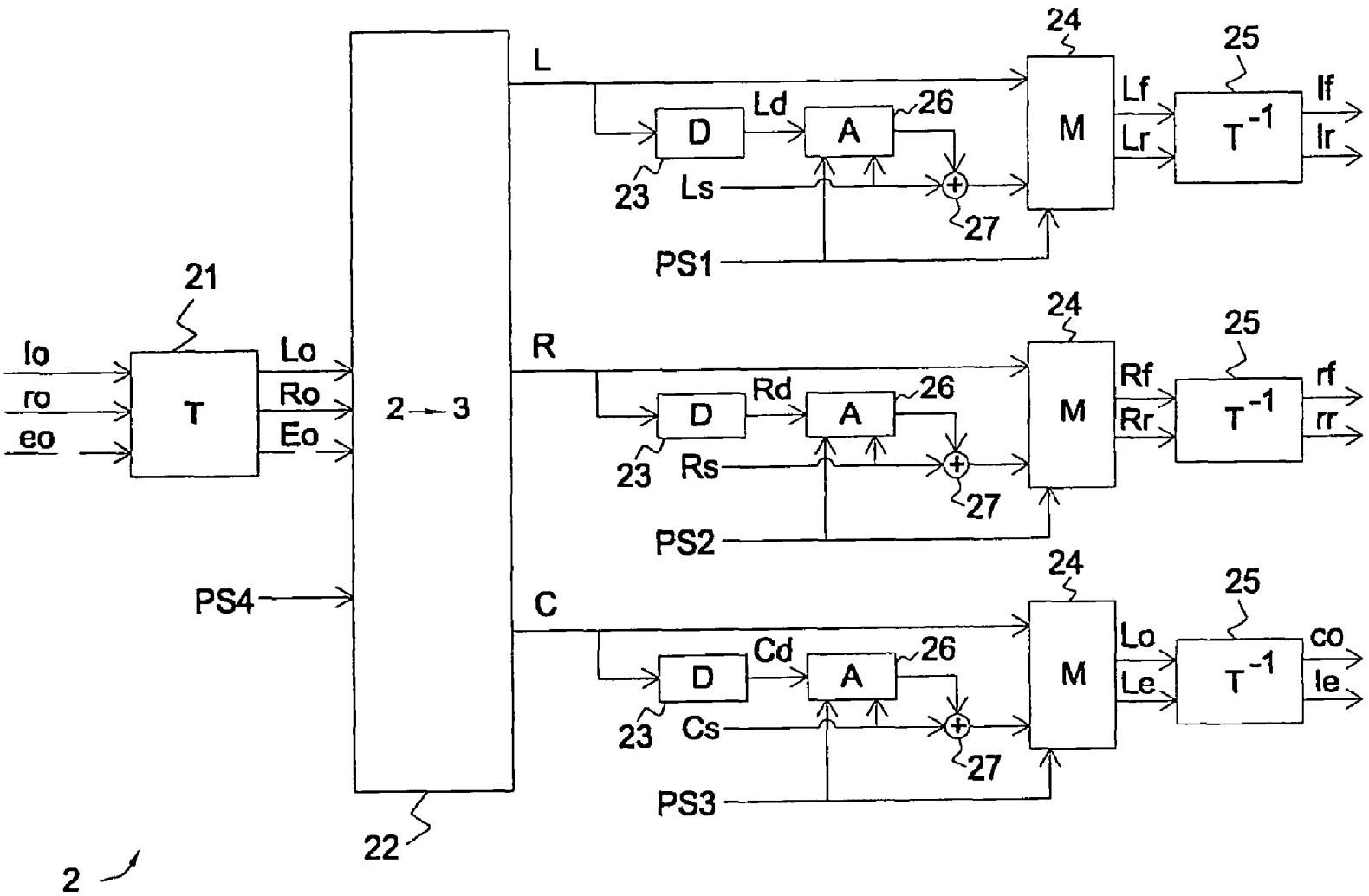

FIG. 9 schematically shows a first embodiment of a decoding device according to the present invention.

Figure 10:
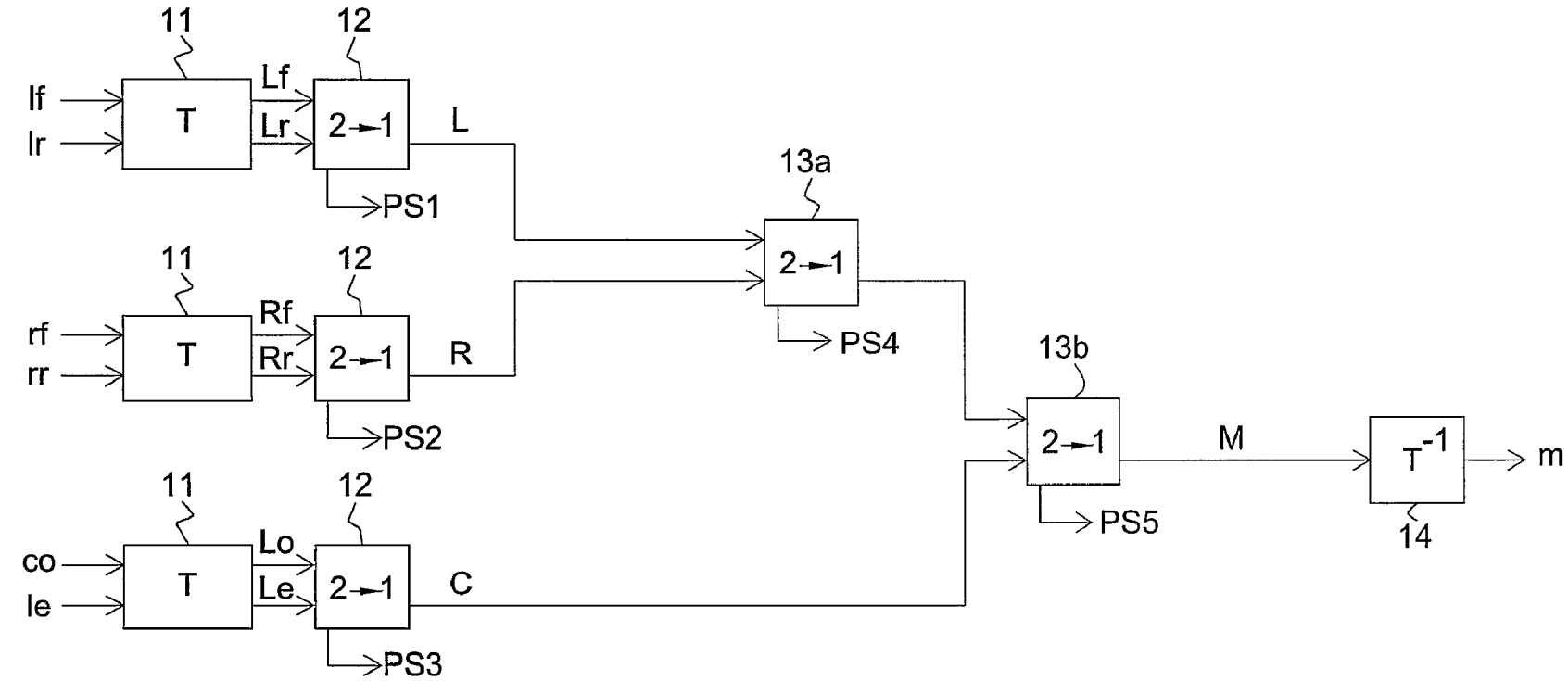
FIG. 10 PRIOR ART

FIG. 10 schematically shows a second embodiment of an encoding device according to the Prior Art.

Figure 11:
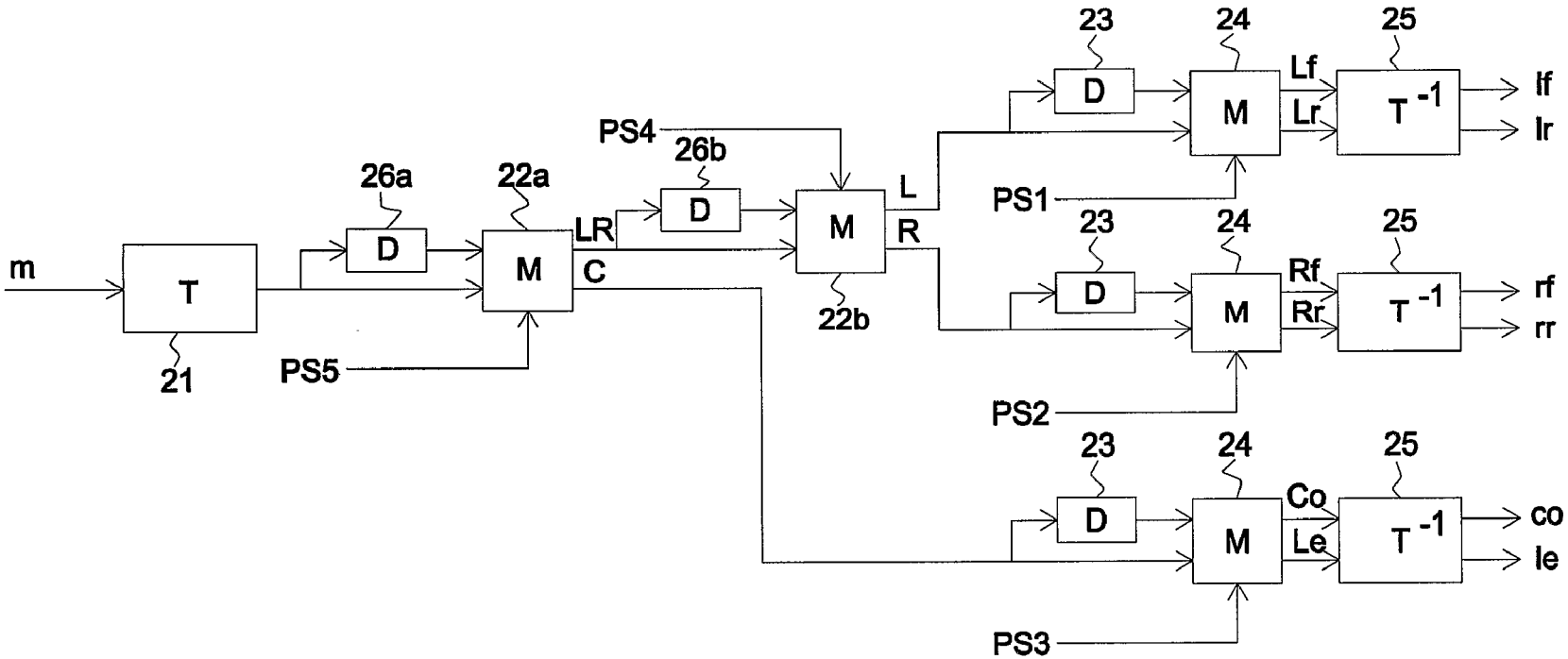
FIG. 11 PRIOR ART

FIG. 11 schematically shows a second embodiment of a decoding device according to the Prior Art.

Figure 12:
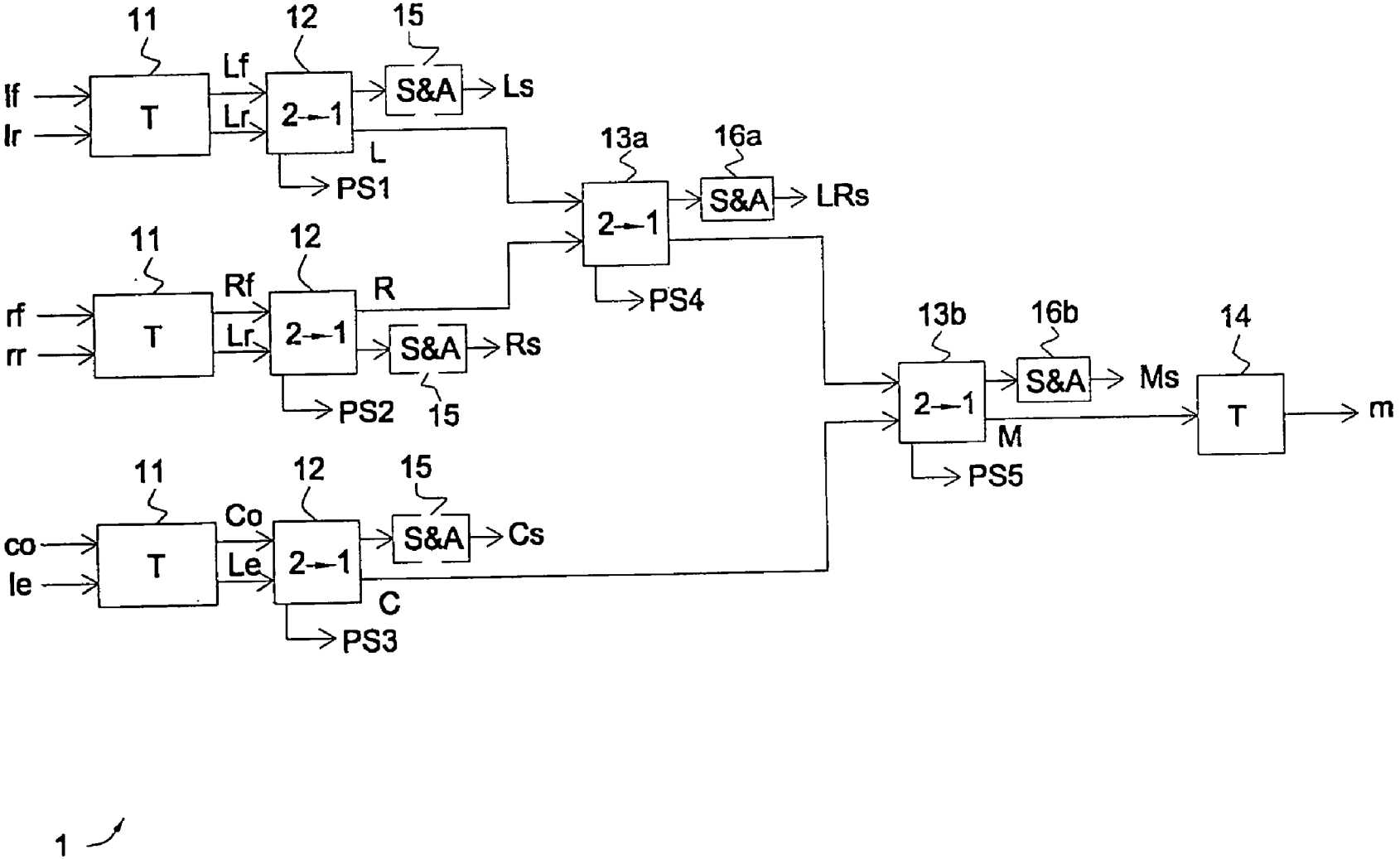

FIG. 12 schematically shows a second embodiment of an encoding device according to the present invention.

Figure 13:
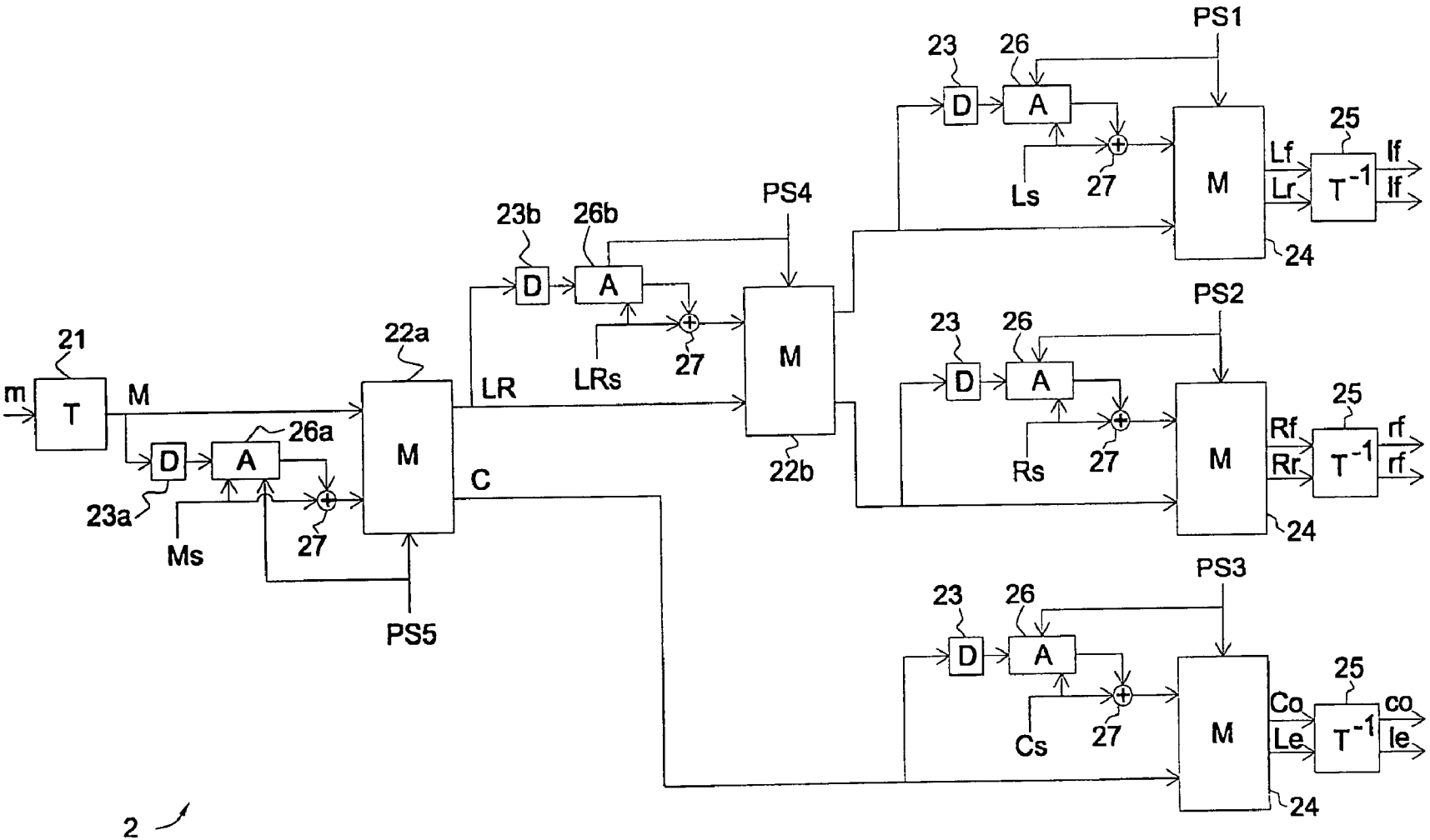

FIG. 13 schematically shows a second embodiment of a decoding device according to the present invention.

The inventive arrangement 10 shown merely by way of non-limiting example in FIG. 1 comprises a 2-to-1 conversion unit 12 and a selection and attenuation (S&A) unit 15. The conversion unit 12 may be a conventional conversion unit arranged for converting a first pair of signals into a second pair of signals, the second pair consisting of a dominant signal containing most signal energy and a residual signal containing the remaining signal energy. The second pair of signals (that is, the dominant and residual signals) may be derived from the first pair using signal rotation or similar techniques, for example using formula (3) above.

In the example of FIG. 1, the conversion unit 12 receives a left signal l[k] and a right signal r[k], which together constitute a stereo signal. The index k represents a frequency band or bin, the signals l[k] and r[k] are preferably derived from time signals l[n] and r[n] using a short-time Fourier transform (STFT) or similar transformation. Accordingly, the signals l[k] and r[k] represent frequency components of a time segment, such as a time frame.

In Prior Art arrangements, the dominant signal m[k] is used for coding while the residual signal s[k] is discarded, the conversion unit 12 producing a dominant signal m[k] and a set of parameters (Pars) associated with the conversion. European Patent Application EP 04103168.3 filed 5 Jul. 2004, corresponding to U.S. patent application Ser. No. 10/599,564, filed Oct. 2, 2006, now U.S. Pat. No. 7,646,875, describes an encoder arrangement in which part of the residual signal s[k] is used. More in particular, in the arrangement of the earlier Application a selector is used which selects perceptually relevant parts of the residual signal while discarding perceptually irrelevant parts. Accordingly, some parts (which may be frequency representations of time frames) are either selected or discarded. European Patent Application EP 04103168.3, the entire contents of which are herewith incorporated in this document, describes the selection of parts of the residual signal in a stereo encoder and decoder. However, the selection of parts of the residual signal in a multi-channel encoding and decoding device, such as a 5.1 arrangement, is not described.

The selection according to the above-mentioned European Patent Application is schematically illustrated in FIG. 3, which shows a weighting function W'. The weight w assigned to parts of the residual signal depends on a relevance factor z, which may be the ratio of the power of the residual signal s[k] and the power of the dominant signal m: z=P(s[k])/P(m[k]), or any other factor indicative of the (relative) perceptual relevance of the residual signal, in particular in comparison to the dominant signal. When the relative power of the residual signal exceeds a certain threshold value $z_0$, the weighting factors w equals 1, which means that the residual signal part is fully encoded and transmitted. When the relative power of the residual signal is smaller than the threshold value $z_0$, the weighting factor w is equal to 0 and the relevant part of the residual signal is discarded.

The present inventors have realized that this selection is too coarse and may cause audible switching artifacts. In particular, the quality of the decoded signals can be improved without significantly increasing the quantity of transmitted data. Accordingly, the present invention provides a selection of (parts of) the residual signal that distinguishes not only between relevant and non-relevant parts, but also identifies less relevant parts: parts that are not as relevant as the (most) relevant parts but are not irrelevant either.

Examples of a weighting function W according to the present invention are schematically shown in FIGS. 4 and 5. In the example of FIG. 4, the weighting function W has two threshold values $z_0$ and $z_1$. If z is less than $z_0$, the weighting factor w is equal to zero. If z is greater than $z_0$ but less than $z_1$, the weighting factor w is (in the present example) equal to 0.5 (it will be understood that other values, such as 0.25 or 0.67, may also be used). If z is greater than $z_1$, w is equal to one. In the example of FIG. 4, therefore, three distinct weighting factor values are used.

In the example of FIG. 5, the weighting factor w increases gradually from 0 (at $z=z_0$) via 0.5 (at $z=z_1$) to 1.0 (at z=1). As a result, only the most relevant signal parts (z=1) have a weighting factor equal to 1, and all signal parts having a relevance factor z greater than $z_0$ have a non-zero weighting factor w. In the example of FIG. 5, theoretically an infinite number of distinct weighting factor values is used. The gradual increase of the weighting function W results in a smooth "switching" between different attenuation levels.

Of course other functions may be used than the ones illustrated in FIGS. 4 and 5. In general, the weighting function will have the property that those parts of the residual signal that make no significant contribution to the reconstruction of the original signal pair l[k], r[k] are removed, parts of the residual signal having an intermediate relevance are being attenuated and highly significant parts are passed substantially unattenuated.

It is noted that instead of power ratios other criteria can be used, such as bandwidth. For example, it can be decided to select signal parts having a frequency lower than a certain threshold frequency, irrespective of their signal power.

The selection and attenuation (S&A) unit 15 according to the present invention shown in FIG. 1 not only selects signal parts but also attenuates certain selected signal parts. In addition to the residual signal s[k] the selection and attenuation unit 15 receives the dominant signal m[k]. In the embodiment shown, the selection and attenuation unit 15 also receives signal parameters (Pars) produced by the 2-1 conversion unit 12, and the original signal pair l[k] and r[k]. Feeding the original signal pair to the selection and attenuation unit 15 provides the possibility of involving the relative powers (or other characteristics) of the original signal pair in the selection and attenuation decisions, in addition to or instead of the relative powers (or other characteristics) of the dominant signal and the residual signal. Feeding-signal parameters to the selection and attenuation unit 15 allows further signal characteristics to be used in the selection and attenuation process.

The selection and attenuation unit 15 outputs the weighted residual signal ws[k] which, together with the dominant signal m[k], may be encoded. It will be understood that the weighted residual signal ws[k] contains less information than the original residual signal s[k] and therefore reduces the bit rate required for transmission of the coded signal pair. On the other hand, the inclusion of the weighted residual signal ws[k] offers a significant improvement of the signal quality compared with Prior Art arrangements in which the residual signal is discarded. The selection and attenuation unit 15 uses a weighting function W as illustrated in FIGS. 4 and 5, or any equivalent tool for selecting and, where appropriate, attenuating the residual signal s[k].

An arrangement in accordance with the present invention for use in a decoding device is schematically illustrated in FIG. 2. The merely exemplary arrangement 20 comprises a mixing unit 24 and a weighting unit 29. The arrangement 20 receives the dominant signal m[k], the weighted residual signal ws[k] and signal parameters (Pars). The dominant signal m[k] is fed to a decorrelator (D) 23 to derive a synthetic residual signal $s_d[k]$, as is done in Prior Art arrangements where the residual signal is not transmitted. This synthetic residual signal $s_d[k]$ is fed to an attenuator 26 where it is attenuated under control of the weighted residual signal ws[k]. Signal parameters may also be fed to the attenuator 26 to additionally control the attenuation of the synthetic residual signal. The resulting attenuated synthetic residual signal and the weighted residual signal are combined in a combination units 27, which in the present embodiment is constituted by an adder. The resulting combined residual signal $s_h[k]$ is fed to an input of the mixing unit 24. The dominant signal m[k] is fed to the other input of the mixing unit 24, while signal parameters (for example including IID and ICC) are fed to a control input of the mixing unit 24 to convert the signal pair m[k], $s_h[k]$ into the signal pair l'[k], r'[k], for example by signal rotation as stated in formula (3) above, or by any other suitable technique.

Accordingly, in the arrangement 20 of the present invention the residual signal $s_h[k]$ fed to the mixing unit 24 is a combination of the (decoded) residual signal ws[k] and an attenuated version of the synthetic residual signal. If no (transmitted) residual signal ws[k] is available, the decorrelated signal $s_d[k]$ is used, substantially without being attenuated. If a residual signal ws[k] is available, the decorrelated signal $s_d[k]$ is attenuated accordingly.

Encoding and decoding devices according to the present invention will be discussed below with reference to FIGS. 8, 9, 12 and 13. However, first an encoding device and a decoding device according to the Prior Art will be discussed with reference to FIGS. 6 and 7.

The Prior Art encoding device 1' is designed for encoding a six channel audio input signal, such as a so-called 5.1 signal, into a two channel audio output signal. In the example shown, the input channels are lf (left front), lr (left rear), rf (right front), rr (right rear), co (center) and le (low frequency effect). All these signals are assumed to be digital time signals and could be written as lf[n], lr[n] etc., with n being a sample number.

The audio input signals are input into segment and transform (T) units 11 which divide the signals into time segments which are then transformed, for example to the frequency domain using an FFT (fast Fourier transform). The time segments into which the time signals are divided preferably overlap partially, as is well known in the art.

The segment and transform units 11 produce transformed signals Lf, Lr, Rf, Rr, Co and Le, which are frequency domain representations of the time segments and could be written as Lf[k], Lr[k], etc. with k being a frequency index. These transformed signals are fed to 2-to-1 converters 12 which convert each pair of input signals (e.g. Lf and Lr) into a dominant signal (e.g. L) and a residual signal while producing an associated set of signal parameters (e.g. PS1). This conversion typically involves a rotation of the signals such that the dominant signal contains most of the signal energy while the residual signal contains the remainder of the signal energy.

In the Prior Art device of FIG. 6, the residual signal is discarded while the dominant signal is fed to a 3-to-2 conversion unit 13. As can be seen, each 2-to-1 conversion unit 12 produces a dominant signal L, R and C and an associated parameter set PS1, PS2 and PS3 respectively. The parameter set contains parameters relating to the conversion carried out by the unit 12, such as a rotation angle $\alpha$, an inter-channel intensity differences parameter IID and/or an inter-channel correlation parameter ICC.

The 3-to-2 conversion unit 13 converts the three input signals L, R and C into the two output signals $L_0$ and $R_0$, while producing an associated parameter set PS4. It is noted that the input signals L and R may respectively be identified with the first and second signals defined above, while the signals $L_0$ and $C_0$ may respectively be identified with the third and fourth signal defined above.

The (transform domain) signal $L_0$ and $R_0$ are fed to an inverse transform ($T^{-1}$) and overlap-and-add (OLA) unit 14 which outputs time-domain signals $l_0$ and $r_0$. The inverse transform is the counterpart of the transform of the units 11 and typically is an inverse FFT. The overlap-and-add operation is substantially the inverse of the segment operation of the units 11 and adds partially overlapping time frames.

It can thus be seen that the Prior Art encoder 1' converts six input audio (time) signals into two output audio (time) signals plus four sets of parameters. In each conversion unit 12 or 13, an output signal is discarded to reduce the number of signals and hence of the required transmission rate.

A compatible decoding device according to the Prior Art is illustrated in FIG. 7. The decoding device 2', which is designed for transforming two audio input channels into six audio output channels, comprises a segment and transform (T) unit 21 for segmenting and transforming the input (time) signals $l_0$ and $r_0$. As in the encoding device, a short-time Fourier transform (STFT) may be used. The resulting (transform domain) signals $L_0$ and $R_0$ are fed to a 2-to-3 conversion unit 22, to which also a (fourth) parameter set PS4 (compare FIG. 6) is supplied. The 2-to-3 conversion unit 22 converts the two signals $L_0$ and $R_0$ into three signals L, R and C which are each fed to a decorrelating (D) unit 23 and a mixing (M) unit 24. The decorrelation units 23 produce decorrelated versions $L_d$, $R_d$ and $C_d$ of the signals L, R and C respectively. These decorrelated signals serve as synthetic residual signals, effectively replacing the signals that were discarded in the encoding device.

The three mixing units 24 each receive a respective parameter set PS1, PS2 and PS3 that controls the (up)mixing operation. If PCA (Principal Component Analysis) is used, a signal rotation is carried out over an angle $\alpha$ contained in the signal parameter sets. Other suitable parameters are, for example, the IID and ICC mentioned above. Not all of these parameters are required, the angle $\alpha$ may be derived from the parameters IID and ICC using:

$$\alpha = \frac{1}{2}\tan^{-1}\left(\frac{2ICC \cdot c}{c^2 - 1}\right) \tag{4}$$

and $$c = 10^{\frac{IID}{20}}. \tag{5}$$

The signals produced by the mixing units 24 are the signal pairs Lf and Lr, Rf and Rr, and Co and Le respectively. These signals are inversely transformed ($T^{-1}$) by the inverse transform and overlap-and-add units 25, which perform a suitable inverse transform such as an inverse FFT and then reconstitute the time signal pairs lf and lr, rf and rr, and co and le. It can thus be seen that the Prior Art decoder 2' converts a pair of audio input signals ($l_0$ and $r_0$) into six audio output signals.

A disadvantage of the known decoding device 2' is that the output signal quality is necessarily limited. In addition, any increase in available transmission capacity does not lead to a corresponding increase in output signal quality. This is mainly due to the fact that the residual signals used by the mixing units 24 are synthetic, that is, derived from the dominant signals. The present invention, as already illustrated with reference to FIGS. 1-5, solves these problems by also transmitting selected parts of the residual signal.

The encoding device 1 according to the present invention illustrated in FIG. 8 is similar to the encoding device 1' of the Prior Art shown in FIG. 6, with the exception of the handling of the residual signals produced by the three 2-to-1 units 12 and the single 3-to-2 unit 13. In the Prior Art device, the residual signals produced by the signal processing (typically signal rotation) operations of the units 12 are discarded, hence the reference to "2-to-1" units. In the device of the present invention, however, these residual signals are not discarded but are output by the units 12 and subsequently processed by the selection and attenuation units 15. This corresponds with the arrangement 10 of FIG. 1, which comprises a 2-to-1 unit 12 and a selection and attenuation unit 15. It will therefore be understood that the transformed input signals (such as Lf and Lr) produced by the segment and transform unit 11, and/or the signal parameters (denoted PS1 . . . PS3 in FIG. 8) produced by the unit 12, may also be fed to the selection and attenuation unit 15.

Each selection and attenuation unit 15 produces a respective residual signal Ls, Rs and Cs which is output by the encoder device 1. Those skilled in the art will understand that these residual signals, as well as the parameter sets PS1, . . . , PS4, may be suitably encoded and/or quantized before being output by the encoding device.

The additional residual channel $E_0$ produced by the 3-to-2 unit 13 may optionally be output as well. This residual channel $E_0$ represents the prediction error of the residual channel $C_0$ mentioned with reference to FIG. 6. The prediction error is equal to the difference of the residual channel $C_0$ and its prediction, which in turn may be a linear combination of $L_0$ and $R_0$. The additional residual channel $E_0$ is preferably not subjected to a selection and attenuation operation (units 15), although this is certainly possible. The inverse transform ($T^{-1}$) and overlap-and-add unit 14 outputs, in the embodiment shown, a residual (time) signal $e_0$ in addition to the regular output (time) signals $l_0$ and $r_0$.

Additional residual channels may be used if additional transmission capacity (bit budget) is available. Accordingly, the additional transmission capacity may be distributed over all additional residual channels. Some distribution preferences may be stated:

additional channels are allocated symmetrically to left-side audio channel blocks and right-side audio channel blocks (a block being, for example, a number of units associated with a channel);

additional channels are allocated first to blocks nearest to the output of the encoding device; and the available transmission capacity is distributed over as many additional channels as possible.

In addition, the bandwidth of additional channels may be limited, for example limited to 2 kHz.

An exemplary compatible decoding device according to the present invention is shown in FIG. 9. The inventive decoding device 2 is similar to the Prior Art decoding device 2' of FIG. 7, with the exception of the units 26 and 27, the use of additional residual channels Ls, Rs and Cs, and the optional use of the further residual channel $e_0$.

As shown in FIG. 9, the decoding device 2 of FIG. 9 comprises three weighting units (29 in FIG. 2), each weighting unit comprising a decorrelation unit 23, an attenuation unit 26 and a combination unit 27. Each of these weighting units receives a respective residual signal Ls, Rs and Cs, together with a respective parameter set PS1, PS2 and PS3. The weighting units 29, which each consist of a decorrelation unit 23, a controlled attenuation unit 26 and a combination unit 27, allow a significantly improved quality of the decoded signals lf, lr, . . . , le, by providing a weighting of the synthetic residual signals and the transmitted residual signals.

It will be understood that the decoding device 2 is not only capable of decoding signals that have been encoded with the encoding device 1 of FIG. 8, but also with other encoding devices which produce residual signals. In other words, it is not necessary for these residual signals to have been weighted with an arrangement 10 as illustrated in FIG. 1, although such weighting would be advantageous. The decoding device 2 is therefore capable of decoding signals that have been encoded by Prior Art encoding devices, for example the Prior Art encoding device of FIG. 6.

Embodiments of the decoding device 2 of the present invention can be envisaged in which the attenuation units 26 are omitted and the decorrelated versions of the channels L, R and C are fed directly to the combination units 27. In such embodiments, which would still be within the scope of the present invention, the use of the additional residual channels Ls, Rs and Cs would still lead to an improved signal quality compared with the Prior Art decoder 2' shown in FIG. 7. However, by providing the attenuation units 26 better use is made of the additional residual channels Ls, Rs and Cs.

The optional further residual channel $e_0$ may be used in the 2-to-3 unit 22 as third channel, thus providing three instead of two input channels. This improves the signal quality when deriving the signals L, R and C from the (transformed) input channels $L_0$ and $R_0$ and the parameter set PS4, for example by adjusting the prediction of the residual channel $C_0$.

A Prior Art 6-to-1 encoding device 1' is shown in FIG. 10. This encoding device comprises three segment and transform units 11, five 2-to 1 units 12, 13*a* and 13*b* and an inverse transform and overlap-and-add unit 14. When compared with the Prior Art encoding device 1' of FIG. 6 it can be seen that the first stages (units 11 and 12) are identical, while the 3-to-2 unit 13 of FIG. 6 has been replaced with two 2-to-1 units 13*a* and 13*b* which together produce a single signal M and two parameter sets PS4 and PS5. The single (transform domain) signal M is inversely transformed and preferably also subjected to an overlap-and-add operation to produce a single audio output (time) signal m which may be stored and/or transmitted.

A corresponding Prior Art 1-to 6 decoding device is illustrated in FIG. 11. The decoding device 2' of FIG. 11 decodes a single audio input (time) signal m into six audio output (time) signals using five upmix (M) units 22*a*, 22*b* and 24. Compared with the Prior Art 2-to-6 decoding device of FIG. 7 it can be seen that the 2-to-3 (upmix) unit 22 has been replaced with the upmix units 22*a* and 22*b*, which each receive a respective parameter set PS5, PS4 to convert the single input signal m into the three intermediate signals L, R and C.

The Prior Art encoding device 1' of FIG. 10 may in accordance with the present invention be modified to produce the inventive 6-to-1 encoding device 1 of FIG. 12. In the merely exemplary embodiment of FIG. 12, selection and attenuation (S&A) units 15, 16*a* and 16*b* have been added to produce additional residual channels Ls, Rs, Cs, LRs and Ms. Accordingly, the encoding device 1 of FIG. 12 produces, in addition to the output signal m, five parameter sets PS1 . . . PS5 and five residual channels Ls, Rs, Cs, LRs and Ms, the residual channels preferably being weighted.

As already indicated above, the selection and attenuation units 15 may be omitted, thus providing additional channels Ls, Rs and Cs that are not weighted. In some embodiments, the selection and attenuation units 16*a* and 16*b* may be omitted. However, it is preferred that all S&A units 15, 16*a* and 16*b* are present, as illustrated in FIG. 12.

It is also possible to select residual channels from the five available residual channels, for example when the transmission capacity is insufficient. In that case, it is preferred to select and transmit residual channels that are nearest to the output terminal of the encoding device 1, that is, nearest to the transform unit 14. These residual channels are the first ones to be used in the corresponding decoding device and therefore have the greatest impact on the decoding process and the quality of the decoded signals. In the example of FIG. 12, the residual channel Ms produced by the 2-to-1 unit 13*b* would be selected first, and then the residual channel LRs produced by the 2-to-1 unit 13*a*. Only when more transmission capacity is available, the residual channels Ls, Rs and/or Cs would be selected.

A compatible 1-to-6 decoder is illustrated in FIG. 13. In the merely exemplary embodiment of FIG. 13, a single audio input (time) channel m is converted into six audio output (time) channels using five parameters sets PS1 . . . PS5 and five residual channels Ms, LRs, Ls, Rs and Cs. Each of the residual channels is processed using an arrangement 20 as illustrated in FIG. 2, each arrangement comprising a decorrelation unit 23 (or 23*a/b*), an attenuation unit 26 (or 26*a/b*), a combination unit 27, and an upmix unit 22*a*, 22*b* or 24. The attenuation units and the combination units allow the residual channels to control the amplitudes of the synthetic residual channels and to provide a suitable mix of the received residual channels and the synthetic residual channels. Accordingly, in the example shown each conversion unit is arranged for receiving a corresponding second signal. This is, however, not essential and only a selected number of conversion units 24 could be arranged for receiving a second signal, for example only the conversion units 22*a* and 22*b*.

The present invention is based upon the insight that, when encoding, the residual signal may be subdivided into at least three categories: perceptually relevant, less relevant and irrelevant, and that the residual signal may be attenuated accordingly. The present invention benefits from the further insight that, when decoding, the decoded residual signal may be used to control the attenuation of a synthetic residual signal to produce a reconstructed residual signal.

The present invention may be utilized in any application involving audio coding, such as internet radio, internet streaming, electronic music distribution (EMD), solid state (e.g. MP3 or AAC) audio players, consumer audio systems, professional audio systems, etc.

It is noted that any terms used in this document should not be construed so as to limit the scope of the present invention. In particular, the words "comprise(s)" and "comprising" are not meant to exclude any elements not specifically stated. Single (circuit) elements may be substituted with multiple (circuit) elements or with their equivalents.

It will be understood by those skilled in the art that the present invention is not limited to the embodiments illustrated above and that many modifications and additions may be made without departing from the scope of the invention as defined in the appending claims.

The invention claimed is:

1. An encoding device for converting a first number of input audio channels into a second number of output audio channels, where the first number is larger than the second number, the encoding device comprising at least two conversion units, each converting unit converting a first signal and a second signal into a third signal and a fourth signal, the third signal containing a portion of the signal energy of the first and second signals greater than a remainder portion of signal energy of the first and second signals contained in the fourth signal, said encoding device using the third signals to produce an output signal, wherein the encoding device further outputs a fourth signal.

2. The encoding device as claimed in claim 1, wherein said encoding device further comprises selection units for selecting time segments for which the fourth signal is to be output.

3. The encoding device as claimed in claim 2, wherein the selection units substantially pass perceptually relevant parts of the fourth signals, attenuate perceptually less relevant parts of the fourth signals, and suppress least relevant parts of the fourth signals.

4. The encoding device as claimed in claim 1, wherein said encoding device comprises at least three conversion units arranged in parallel, each conversion unit being coupled to outputs of a respective segment and transformation unit for producing transformed time segments, the encoding device further comprising an inverse transform and overlap-and-add unit for producing an output time signal.

5. The encoding device as claimed in claim 1, wherein said encoding device comprises at least two cascaded conversion units, wherein the conversion unit nearest to the output terminal of the encoding device is selected to output its fourth signal, the fourth signal of other conversion units being discarded.

6. An audio system, comprising an encoding device as claimed in claim 1.

7. A decoding device for converting a first number of input audio channels into a second number of output audio channels, where the first number is smaller than the second number, the decoding device comprising at least two conversion units for converting a first signal and a second signal into a third signal and a fourth signal, the first signal containing a portion of the signal energy of the third and fourth signals greater than a remainder portion of the signal energy of the third and fourth signals contained in the second signal, the decoding device further comprising at least one decorrelation unit for decorrelating the first signal so as to produce a synthetic second signal, said decoding device further receiving at least one additional second signal.

8. The decoding device as claimed in claim 7, wherein each conversion unit receives a corresponding second signal.

9. The decoding device as claimed in claim 7, wherein said decoding device further comprises at least one attenuation unit controlled by a received second signal for attenuating a corresponding synthetic second signal.

10. The decoding device as claimed in claim 9, wherein said decoding device further comprises at least one combination unit for combining the synthetic second signal and the received second signal so as to use a resulting combined signal in the conversion unit.

11. The decoding device as claimed in claim 7, wherein said decoding device comprises three conversion units arranged in parallel.

12. The decoding device as claimed in claim 7, wherein said decoding device further comprises at least one segment and transform unit and at least two inverse transform and overlap-and-add units.

13. An audio system, comprising a decoding device as claimed in claim 7.

14. A method of converting a first number of input audio channels into a second number of output audio channels, where the first number is larger than the second number, the method comprising at least two steps of converting a first signal and a second signal into a third signal and a fourth signal, the third signal containing a portion of the signal energy of the first and second signals greater than a remainder portion of the signal energy of the first and second signals contained in the fourth signal, and the step of using the third signals to produce an output signal, said method further comprising the step of outputting a fourth signal (Ls; Rs; Cs).

15. The method as claimed in claim 14, wherein said method comprises at least two cascaded conversion steps, wherein the fourth signal of a conversion step downstream of the cascade is transmitted, the fourth signals of other conversion steps being discarded.

16. A non-transitory computer-readable medium containing a computer program causing a computer, when executing said computer program, to carry out the method as claimed in claim 14.

17. A method of converting a first number of input audio channels into a second number of output audio channels, where the first number is smaller than the second number, the method comprising at least two steps of converting a first signal and a second signal into a third signal and a fourth signal, the first signal containing a portion of the signal energy of the third and fourth signals greater than a remainder portion of the signal energy of the third and fourth signals contained in the second signal, and the step of deriving the second signal from the first signal, said method further comprising the step of receiving an additional second signal.

18. The method as claimed in claim 17, wherein said method further comprises the step of decorrelating a first signal so as to produce a synthetic second signal.

19. The method as claimed in claim 18, wherein said method further comprises the step of attenuating the synthetic second signal, said step being controlled by a corresponding received second signal.

20. The method as claimed in claim 19, wherein said method further comprises the steps of combining the synthetic second signal and the received second signal, and using the combined signal in the conversion step.

* * * * *